US005077997A

United States Patent [19]

Wolters et al.

[11] Patent Number: 5,077,997

[45] Date of Patent: Jan. 7, 1992

[54] METHOD FOR COMPENSATING IRREGULARITIES CAUSED BY ROLL ECCENTRICITIES

[75] Inventors: Hermann Wolters, Hilchenbach-Müsen; Siegfried Latzel, Siegen, both of Fed. Rep. of Germany

[73] Assignee: SMS Schloemann-Siemag Aktiengesellschaft, Dusseldorf, Fed. Rep. of Germany

[21] Appl. No.: 603,475

[22] Filed: Oct. 25, 1990

[30] Foreign Application Priority Data

Oct. 25, 1989 [DE] Fed. Rep. of Germany ..... 3935434

[51] Int. Cl.[5] ..... B21B 37/12; G06F 15/46

[52] U.S. Cl. ..... 72/8; 72/16; 72/20; 364/472

[58] Field of Search ..... 72/8, 16, 20, 21; 364/472

[56] References Cited

U.S. PATENT DOCUMENTS

| | | | |
|---|---|---|---|
| 4,036,041 | 7/1977 | Ichiryu et al. | 72/8 |
| 4,222,254 | 9/1980 | King, Jr. et al. | 72/8 |
| 4,545,228 | 10/1985 | Yamaguti et al. | 72/8 |
| 4,648,257 | 3/1987 | Oliver et al. | 72/8 |
| 4,685,063 | 8/1987 | Weihrich et al. | 72/16 |
| 4,691,547 | 9/1987 | Teoh et al. | 72/8 |
| 4,910,985 | 3/1990 | Ballyns | 72/8 |

*Primary Examiner*—Lowell A. Larson
*Assistant Examiner*—Thomas C. Schoeffler
*Attorney, Agent, or Firm*—Toren, McGeady & Associates

[57] ABSTRACT

A method and an arrangement for regulating the thickness of rolled strip utilizing the gauge meter method and for compensating irregularities caused by roll eccentricities, wherein the size of the roll gap, the rolling force and the stand modulus are taken into consideration. The method includes separating a disturbance signal due to the eccentricities of rolls from an actual rolling force signal, identifying the disturbance signal obtained in this manner by determining its transmission function, subsequently computing the regulating parameters in dependence upon the determined disturbance signal transmission function and with the aid of a regulating synthesis method. A compensation signal is determined from the disturbance signal and the corresponding regulating parameters in an adaptive regulator for compensating the irregularities due to eccentricities. The compensation signal is introduced in a position regulating circuit.

8 Claims, 2 Drawing Sheets

METHOD FOR COMPENSATING IRREGULARITIES CAUSED BY ROLL ECCENTRICITIES

BACKGROUND OF THE INVENTION

1. Field of the Invention

The present invention relates to a method for controlling the thickness of rolled strips and for compensating irregularities caused by roll eccentricities, in which the size of the roll gap, the rolling force and the stand modulus are taken into consideration.

The present invention also relates to an arrangement for carrying out the method.

2. Description of the Related Art

In recent years, the requirements concerning increasingly narrower tolerances in relation to the thickness of rolled strips have continuously grown. It has soon been found that the influence of roll eccentricities has a disadvantageous effect when an attempt is made to maintain such narrow tolerances. For this reason, circuits have been developed which have the purpose of compensating the influence of roll eccentricities which reduce the quality of the rolled strip.

For example, it is known in the art initially to measure the eccentricity of the rolls when the rolls are moved together, to store the measured values and to reuse these measured values during the rolling procedure in order to compensate the roll eccentricities. Changes in the eccentricities of the rolls because of roll wear, thermally influenced changes, changes due to slippage etc., cannot be recognized by means of this compensation method. As a result, no compensation or only insufficient compensation takes place.

European patent 0170016 discloses a method for compensating the influence of roll eccentricities in which a disturbance signal is filtered out of the actual value of the rolling force, the roll adjustment and the stand springiness constant with the aid of the rate of rotation of the back-up rolls and in which the disturbance signal is reconstructed by means of oscillators. The reconstructed disturbance signal is used for controlling the thickness regulator of the roll stand.

The reasons for the eccentricities are grinding inaccuracies of the rolls, uneven wear, pressure variations in the bearings of the rolls, thermally caused eccentricities and others. All these irregularities can occur at each roll of a stand and are superimposed, so that very complex disturbance signal patterns result which can be reconstructed with reasonable accuracy only with substantially difficult and expensive oscillators. In addition, the rolls which are used have different diameters and are therefore driven with different rates of rotation, so that a filter controlled by the rate of rotation of the back-up rolls cannot be adjusted in an optimum manner for all rolls. Accordingly, the compensation of eccentricities according to this method is also insufficient.

SUMMARY OF THE INVENTION

It is, therefore, the primary object of the present invention to provide a method for regulating the thickness of rolled strip and for compensating roll eccentricities which makes possible the exact compensation of even complex roll eccentricities caused by the superimposition of several disturbing influences. Another object of the invention is to further improve an arrangement for carrying out the method for compensating roll eccentricities.

In accordance with the present invention, the above-described method for regulating the thickness of rolled strip utilizing the gauge meter method and for compensating irregularities caused by roll eccentricities, in which the size of the roll gap, the rolling force and the stand modulus are taken into consideration, includes the known separation of the disturbance signal due to the eccentricities of rolls from the actual rolling force signal. The disturbance signal obtained in this manner is identified by determining its transmission function. Subsequently, the regulating parameters are computed in dependence upon the determined disturbance signal transmission function and with the aid of a regulating synthesis method. The compensation signal is determined from the disturbance signal and the corresponding regulating parameters in an adaptive regulator for compensating the irregularities due to eccentricities. Finally, the compensation signal is introduced in the position regulating circuit.

The arrangement according to the present invention for carrying out the above-described method includes a monitor regulating circuit, a gauge meter regulating circuit, a position regulating circuit and an eccentricity regulating circuit. The arrangement further includes a filter for filtering out the disturbance signal from the actual rolling force signal in dependence upon the preset position value of the gauge meter circuit. A delay unit impresses the dynamic behavior of the position regulating circuit on the preset position value. Further provided are an adder for adding to the rolling force signal obtained in this manner the negated actual rolling force signal, an identification circuit in which the transmission function of the disturbance signal is determined, a computing unit which derives regulating parameters from the transmission function of the disturbance signal, and an adaptive regulator which produces a position correction signal on the basis of its regulating structure of the regulating parameters and of the disturbance signal. The output of the adaptive regulator is connected with the output of the gauge meter circuit to the position regulating circuit.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
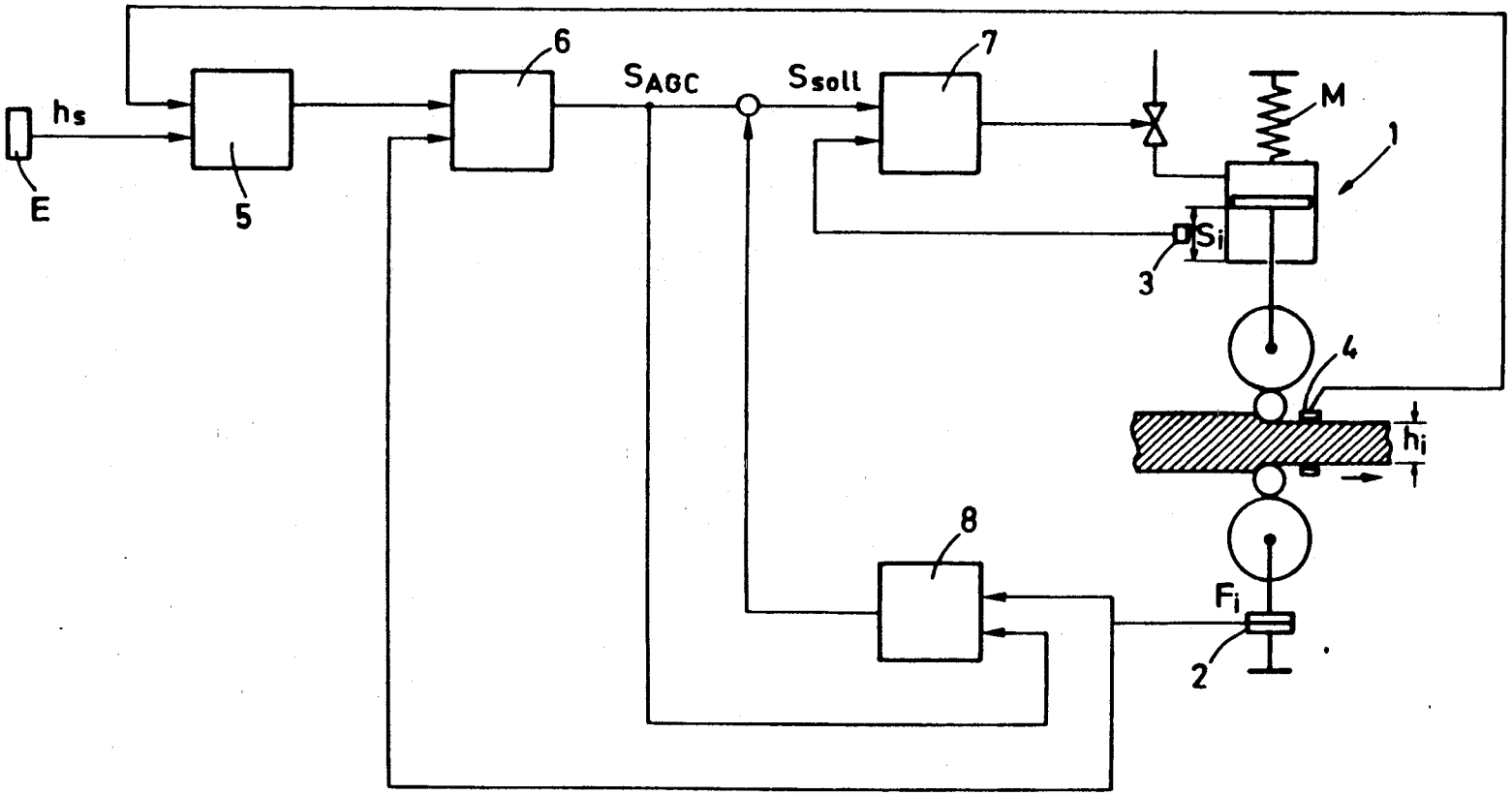
FIG. 1 is a schematic representation of a rolling mill stand with regulating units.

FIG. 1 of the drawing schematically shows a rolling mill stand 1. The rolling mill stand 1 has a pickup 2 for the actual rolling force $F_i$ and a pickup 3 for the actual adjustment $S_i$. Arranged after the rolling mill stand 1 is a pickup 4 for the actual strip thickness $h_i$ of the strip leaving the rolling mill stand 1. The rolling mill stand 1 is provided with a thickness regulator which includes a monitor regulating circuit 5, a gauge meter regulating circuit 6 and a position regulating circuit 7. In addition, a roll eccentricity compensation regulating circuit 8 is provided. The desired thickness $h_s$ of the strip can be fed in through an input unit E.

Figure 2:
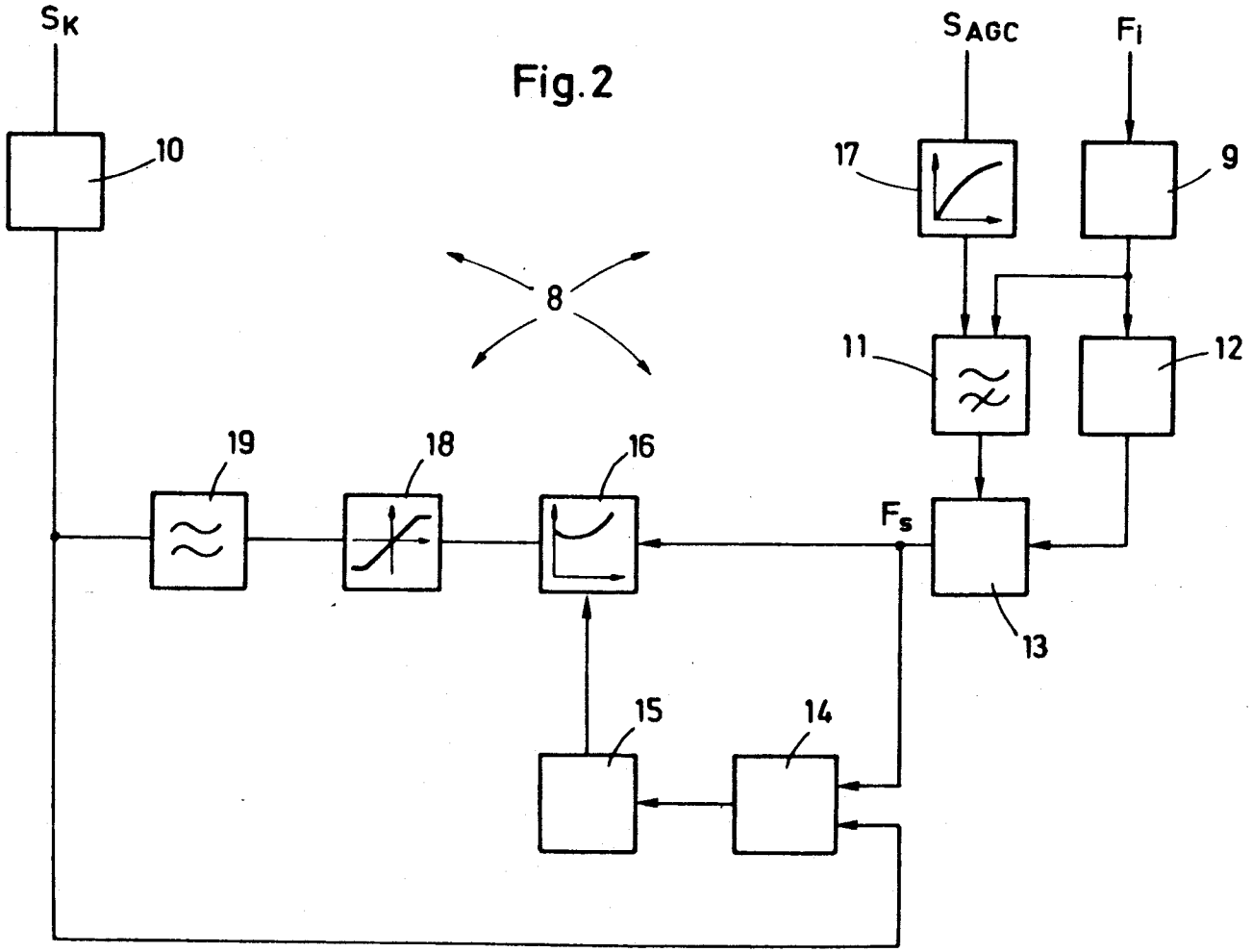
FIG. 2 is a schematic representation of the roll eccentricity compensation circuits.

FIG. 2 of the drawing schematically illustrates the roll eccentricity compensation circuit 8. The compensation circuit 8 includes an A/D transducer 9 at the input and a D/A transducer 10 at the output. A non-linear filter 11 is coupled to the A/D transducer 9. The output of the gauge meter circuit 6 is simultaneously connected to the filter 11. A preset position value $S_{AGC}$ can be picked up at the output of the gauge meter circuit 6 through a delay unit 17 which impresses the dynamic behavior of the position regulating circuit 7 onto the preset position value $S_{AGC}$. The A/D transducer 9 additionally cooperates with a negator 12 which is connected to an adder 13. The output of the filter 11 is also connected to the adder 13. The output of the adder 13 is coupled to an identification unit 14 which, in turn, cooperates with a computing unit 15 for computing regulating parameters. The outputs of the computing unit 15 and the adder 13 are connected to a regulator 16. The output of the regulator 16 is connected through the limiter 18 and the filter 19 to the identification unit 14, on the one hand, and to the D/A transducer 10, on the other.

The compensation regulating circuit 8 operates as follows.

The compensation regulating circuit 8 requires as input signals the rolling force signal $F_i$ and the preset position value $S_{AGC}$ formed by the gauge meter circuit 6. Accordingly, only those signals are required which are already available for conventional thickness regulation, so that additional pickups, for example, for the rate of rotation, etc., are not necessary.

The analog actual rolling force signal $F_i$ is digitalized in the A/D transducer 9 and is fed to the filter 11. The filter 11 is a non-linear low-pass filter. In order to obtain a very smooth actual rolling force signal, i.e., to separate out the higher frequency disturbance signal while simultaneously being able quickly to react to amplitude changes of the input signal, the filter 11 is controlled by the preset position value $S_{AGC}$, wherein simultaneously the dynamic behavior of the position regulating circuit 7 is taken into consideration. The rolling force signal available at the output of the filter is added in the adder 13 to the actual rolling force signal $F_i$ negated in the negator 12. Accordingly, the disturbance signal $F_s$ caused by roll eccentricities is available at the output of the adder 13.

The dynamic behavior of the disturbance signal $F_s$ is identified in the identification unit 14, i.e., the Z-transmission function of the disturbance signal $F_s$ is determined as follows:

$$\frac{F_s(Z)}{S_k(Z)} = \frac{b_1 Z^{-1} + \ldots b_n Z^{-n}}{1 + a_1 Z^{-1} + \ldots a_m Z^{-m}} \quad (1)$$

The unknown parameters $a_{1-m}$, $b_{1-n}$ are estimated by means of a recursive parameter estimating method.

Due to the large number of the superimposed eccentricities, a very complex disturbance signal $F_s$ must be reconstructed which would result in a differential equation of a high order. The order of the disturbance signal in the model (1) can be significantly reduced without great disadvantages by means of simplification during the reconstruction, so that the parameters of the signal model can be estimated on-line. The simplification requires that the scanning frequency is increased; however, modern computers are able to meet these requirements.

The parameters of the regulator 16 are computed in the computing unit 15 in dependence upon the determined disturbance signal transmission function (1) and with the aid of regulating synthesis method. As a result, the regulator 16 is adapted to the actual disturbance signal behavior and compensation signals $S_k$ are produced taking into consideration the desired regulating circuit behavior and the determined disturbance signal $F_s$.

In order to ensure that amplitudes of the compensation signal $S_n$ which are too large and which could negatively influence the thickness of the rolled strip are introduced into the position regulating circuit 7, the compensation signal $S_k$ is limited in the limiter 18 to maximum amplitudes which can be fixed. For smoothing the regulator output, the compensation signal $S_k$ can be smoothened by means of a filter 19. After the D/A conversion, the compensation signal $S_k$ is added to the preset position value $S_{AGC}$ of the gauge meter circuit 6. The compensation signal $S_k$ is simultaneously returned to the identification circuit 14.

While a specific embodiment of the invention has been shown and described in detail to illustrate the application of the inventive principle, it will be understood that the invention may be embodied otherwise without departing from such principles.

We claim:

1. A method for regulating the thickness of rolled strip utilizing a gauge meter method and for compensating irregularities caused by roll eccentricities, wherein the size of the roll gap, the rolling force and the stand modulus are taken into consideration, the method comprising separating a disturbance signal due to eccentricities of rolls from an actual rolling force signal, identifying the disturbance signal obtained in this manner by determining its transmission function, subsequently computing regulating parameters in dependence upon the determined disturbance signal transmission function and with the aid of a regulating synthesis method, determining a compensation signal from the disturbance signal and the corresponding regulating parameters in an adaptive regulator for compensating the irregularities due to eccentricities, and finally introducing the compensation signal in a position regulating circuit.

2. The method according to claim 1, comprising filtering the disturbance signal out from the rolling force signal through a non-linear filter, the filter being controlled with the preset position value while taking into consideration the dynamic behavior of the position regulating circuit, and determining the disturbance signal by adding the rolling force signal obtained in this manner with the actual rolling force signal.

3. The method according to claim 2, comprising reconstructing on-line a disturbance signal pattern as transmission function during an adaptive regulation through estimating the parameters by means of a recursive parameter estimating method.

4. The method according to claim 3, comprising producing a position correction signal on the basis of the disturbance signal and the regulating parameters derived from the transmission function, and adding the position correction signal to the preset position value of the gauge meter circuit to obtain a desired position value.

5. The method according to claim 4, comprising limiting the amplitude of the position correction signal and smoothing high-frequency compensation signals by filtering the regulator output.

6. An arrangement for regulating the thickness of rolled strips utilizing a gauge meter method and for compensating irregularities caused by roll eccentricities, the arrangement comprising a monitor regulating circuit, a gauge meter regulating circuit, a position regulating circuit, an eccentricity regulating circuit, a filter for filtering a disturbance signal from an actual rolling force signal in dependence upon a preset position value of the gauge meter circuit, a delay unit for impressing the dynamic behavior of the position regulating circuit on the preset position value, an adder for adding to the rolling force signal obtained in this manner a negated actual rolling force signal, an identification circuit for identifying the transmission function of the disturbance signal, a computing unit for deriving regulating parameters from the transmission function of the disturbance signal, and an adaptive regulator for producing a position correction signal on the basis of a regulating structure of the regulating parameters and of the disturbance signal, wherein an output of the adaptive regulator is connected with an output of the gauge meter circuit to the position regulating circuit.

7. The arrangement according to claim 6, comprising an A/D transducer for digitalizing the actual rolling force signal, wherein the filter is a non-linear digital low-pass filter.

8. The arrangement according to according to claim 6, comprising a limiter for the position correction signal and another filter, the limiter and the another filter being connected following the adaptive regulator.

* * * * *